United States Patent [19]

O'Connell

[11] 4,033,692

[45] July 5, 1977

[54] MULTI-MODE REPRODUCING MACHINE

[75] Inventor: Richard P. O'Connell, Rochester, N.Y.

[73] Assignee: Xerox Corporation, Stamford, Conn.

[22] Filed: Oct. 30, 1975

[21] Appl. No.: 627,433

[52] U.S. Cl. ..... 355/14; 355/3 R

[51] Int. Cl.[2] ..... G03G 15/00

[58] Field of Search ..... 355/3 R, 7, 8, 11, 14

[56] References Cited

UNITED STATES PATENTS

| | | | |
|---|---|---|---|
| 3,076,392 | 2/1963 | Cerasani et al. | 355/14 X |
| 3,542,467 | 11/1970 | Ferguson et al. | 355/8 |
| 3,556,655 | 1/1971 | Lux et al. | 355/3 R UX |
| 3,639,057 | 2/1972 | Thomas et al. | 355/66 X |
| 3,778,147 | 12/1973 | Reehil et al. | 355/8 |
| 3,792,926 | 2/1974 | Knechtel et al. | 355/14 X |
| 3,865,482 | 2/1975 | Bendall et al. | 355/14 |

*Primary Examiner*—George H. Miller, Jr.

*Attorney, Agent, or Firm*—James J. Ralabate; Michael H. Shanahan; Paul Weinstein

[57] ABSTRACT

A reproducing apparatus for producing copies of a document selectively at one of a plurality of copy image magnifications by moving original exposure. A feeder advances the document past a viewing system selectively at one of a plurality of velocities corresponding to the copy image magnifications. An edge of the document is sensed as it is advanced by the feeder. Responsive to the sensing of the document edge exposure is initiated selectively after expiration of one of a plurality of time intervals corresponding to the copy image magnification and the velocities of document advancement. In accordance with an alternative embodiment the document feeder advances the document past a plurality of document viewing positions corresponding to different desired copy image magnifications and the time intervals correspond to the viewing position as well.

10 Claims, 6 Drawing Figures

MULTI-MODE REPRODUCING MACHINE

CROSS REFERENCE TO RELATED APPLICATIONS

U.S. application Ser. No. 627,434, filed of even date herewith, to stemmle for a variable magnification copier.

BACKGROUND OF THE INVENTION

This invention relates to a multi-mode reproducing apparatus preferably of the electrostatographic type. The apparatus includes means for copying documents selectively at a plurality of magnifications.

A variety of electrostatographic reproducing machines are commercially employed which have different modes of operation. One type of machine utilizes a moving original exposure system wherein an original document is moved past a fixed slit optical system for projecting an image onto a moving photoconductive surface. These machines include a means for changing the magnification of the projected image and the speed of the moving original to provide reduction copies. Exemplary of patents in this area are U.S. Pat. Nos. 3,076,392 to Cerasani et al., and 3,649,114 to Vlach et al.

Other machines have been adapted to copy stationary original documents at a variety of magnifications or reductions through the use of a scanning optical system with different scanning speeds and conjugate changing systems. Exemplary of patents in this area are U.S. Pat. Nos. 3,476,478 to Rees, Jr.; 3,542,467 to Furgeson; U.S. Pat. Nos. 3,614,222 to Post; and 3,837,743 to Amemiya.

Another type of variable magnification copier, in which full frame flash exposure is made of a stationary original document, is show, for example, in U.S. Pat. No. 3,778,147 to E. G. Reedhil et al. It discloses delaying the application of the flash energizing pulse in response to the selected magnification ratio.

The aforenoted machines are adapted to provide one or more modes of copying having different magnifications. Other forms of multi-mode copiers are available commercially. For example, in the Xerox 3100 LDC machine an optical system is provided which enables the machine to copy from a stationary original in a first scanning mode or from a moving original in a second fixed optical mode. This latter mode is particularly adapted for copying documents larger than the conventional viewing platen size. U.S. Pat. No. 3,900,258 to Hoppner et al [1] is illustrative of a machine similar in many respects to the 3100 LDC machine.

Reproducing apparatuses including the capability of making copies from both moving and stationary originals are also described in U.S. Pat. No. 3,833,296 to Vola, and in IBM Technical Disclosure Bulletin, Vol. 12, No. 1, at page 173, June 1969.

In U.S. application Ser. No. 549,684, to Bar-on. and U.S. application Ser. No. 598,612 to Hughes, there are disclosed reproducing machines wherein belt type document feeders are utilized for advancing documents over a platen and past a fixed scanning optical system for providing moving original exposure. In the latter application a moving original exposure mode for reduction copying may be employed.

It has been found desirable, to provide a multimode reproducing apparatus having various unique features of the 3100 LDC machine, including its extremely compact size, but also having the capability of reduction copying.

One approach to such a machine is described in U.S. application Ser. No. 588,971 to Hoppner et al. [2]. In that application a multimode reproducing apparatus is provided including both moving and stationary original exposure modes, with at least two modes of moving original exposures at differing copy image magnifications.

In the apparatus of the Hoppner et al. [2] application, only two modes of moving original exposure are shown although additional modes could be provided. One at a nominal magnification wherein the add mirror is positioned out of the optical path and one at a reduced magnification wherein the add mirror is positioned in the optical path. If it is desired to provide multiple reduction modes, then it would be necessary not only to translate the lens to a still different position, but also to adjust the position of the add mirror to again change the appropriate conjugate.

In the Xerox 3100 LDC machine, in the moving original mode of operation, the copying cycle is initiated by the document lead edge intercepting a switch in the document feeder. After the document has actuated the switch, the machine programmer carries out the copying cycle in an appropriately timed sequence. The switch is located upstream of the exposure or viewing position and, therefore, exposure takes place a predetermined time interval following actuation of the switch.

When performing reduction copying using moving original exposure as in the Hoppner et al. [2], the document is advanced at a more rapid rate and, therefore, it will reach the exposure in a shorter time after actuation of the switch than a document in a 1:1 mode of copying. This will result in a mis-registration between the document and the copy sheet.

In U.S. application Ser. No. 627,432 to Bierworth et al filed of even data herewith, there is described a reproducing machine having a plurality of modes of variable magnification copying by moving original exposure. In that machine, as with the machines noted above, the document is advanced at a variety of speeds proportional to the magnification of the resulting copy image. One feature of that application is the provision of different viewing positions in correspondence to the different projected image magnifications. The use of different viewing positions as well as different document advancing speeds further complicates the problem of obtaining proper registration between the document and the copy sheet when the copying cycle is programmed from the actuation of the document lead edge switch.

Various prior art approaches have been utilized in copying machines for providing copies with a variety of projected image magnifications as noted above. The problem of maintaining registration between the document and the copy sheet for different document advancement rates corresponding to different magnifications has been addressed by the prior art in a variety of ways as, for example, those illustrated in U.S. Pat. Nos. 3,556,655 to Lux et al, and 3,639,057 to Thomas et al. In the Lux et al patent for reduction copying wherein the document is advanced faster than the copy sheet an arrangement is provided whereby the original is momentarily held while the copy sheet advances to center the reduced image on the copy sheet. A time delay relay is utilized to stagger the movement of the original and the copy sheet through the machine so that the copy produced on the copy sheet is centered.

SUMMARY OF THE INVENTION

In accordance with this invention a multi-mode reproducing apparatus is provided having an improved means for copying selectively at a variety of copy image magnifications. Exposure of the document is initiated after one of a plurality of selectable time intervals has expired following the actuation of a document sensing switch. Each time interval corresponds to a desired copy image magnification. Preferably, in accordance with this invention, each of the selectable time intervals may be varied within a desired time interval range.

In accordance with one exemplary embodiment the apparatus includes an imaging surface arranged for movement at a given velocity. Means are provided for viewing a moving document and for projecting an image thereof onto the imaging surface selectively at one of a plurality of copy image magnifications. A feeding means advances the document past the viewing means continuously and selectively at one of a plurality of velocities corresponding to the copy image magnification. The feeding means advances the document in synchronism with the movement of the imaging surface. Sensing means sense the document as it is continuously advanced by the feeding means. Means are provided responsive to the sensing means for initiating exposure of the document by the viewing means selectively after expiration of one of a plurality of time intervals corresponding to the copy image magnification and the velocity of document advancement.

In accordance with an alternative embodiment, in addition to the above, a plurality of document viewing positions are provided corresponding to the different desired copy image magnifications. The feeding means is arranged to advance the document past the viewing positions and the viewing means is arranged to view the document selectively at one of the viewing positions to provide selectively one of the plurality of copy image magnifications corresponding to the viewing position.

Preferably, each of the selectable time intervals may be varied within a range of time intervals to allow for adjustments and changes in copy image magnification, viewing position, etc.

Accordingly, it is an object of this invention to provide an improved multi-mode reproducing apparatus.

It is a further object of this invention to provide an apparatus as above including selectable time intervals following document sensing for initiating exposure of a document.

These and other objects will become more apparent from the following description and drawings.

DETAILED DESCRIPTION OF THE PREFERRED EMBODIMENTS

In accordance with this invention a unique approach has been devised for controlling moving original exposure of the document. Exposure is initiated after one of a plurality of selectable time intervals has expired following the actuation of a document sensing switch. Each time interval corresponds to a desired copy image magnification. Preferably. in accordance with this invention each of the selectable time intervals may be varied within a desired time interval range.

Figure 1:
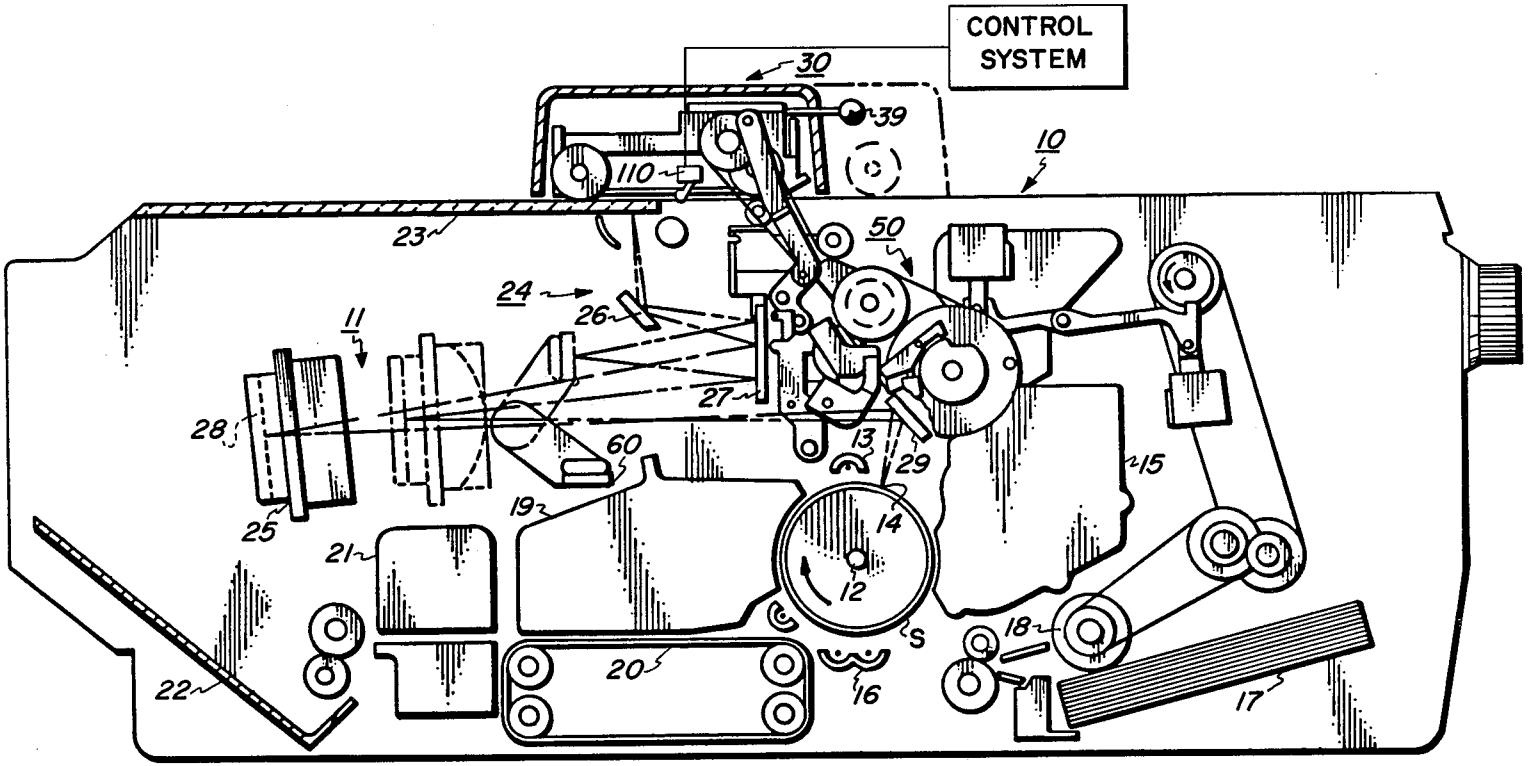
FIG. 1 is a schematic side view of a reproducing apparatus in accordance with one embodiment of the present invention.

Referring now to FIG. 1, there is shown by way of example an electrostatographic reproducing machine 10 which incorporates the selectable time delay apparatus of the present invention. The reproducing machine 10 depicted in FIG. 1 is similar in most respects to that described in greater detail in the Hoppner et al. [2] application and illustrates the various components utillized therein for xerographically producing copies from an original. Although the apparatus of the present invention is particularly well adapted for use in an automatic xerographic reproducing machine 10, it should become evident from the following description that it is equally well suited for use in a wide variety of systems and is not necessarily limited in its application to the particular embodiment shown herein.

Basically, the xerographic processor includes a rotatably mounted photoconductive drum S which is supported upon a horizontally extended shaft 12. The drum is driven in the direction indicated whereby its photoconductive imaging surface is caused to pass sequentially through a series of xerographic processing stations.

The practice of xerography is well-known in the art, and is the subject of numerous patents and texts, including *Electrophotography* by Schaffert, published in 1965, and *Xerography and Related Processes*, by Dessauer and Clark, published in 1965. Therefore, the various processing steps involved will be briefly explained below in reference to FIG. 1. Initially, the photoconductive drum surface is uniformly charged by means of a corona generator 13 positioned within a charging station located at approximately the 12 o'clock drum position. The charged drum surface is then advanced into an imaging station 14 wherein a flowing light image of an original document to be reproduced is projected onto the charged drum surface thus recording on the drum a latent electrostatic image containing the original input scene information. Next, subsequent to the exposure step in the direction of drum rotation is a developing station 1 wherein the latent electrostatic image is rendered visible by applying an electroscopic marking powder (toner) to the photoreceptor surface in a manner well known and used in the art. The now visible image is then forwarded into a transfer station 16 wherein a sheet of final support material is brought into overlying moving contact with the toner image and the image transferred from the plate to the support sheet by means of a second corona generator 16.

In operation, a supply of cut sheets are supported within the machine by means of a paper cassette 17. A pair of feed rollers 18 are arranged to operatively engage the uppermost sheet in the cassette so as to first separate the top sheet from the remainder of the stack and then advance the sheet into the transfer station in synchronous moving relationship to the developed image on the photoconductive plate surface. The motion of the feed rollers is coordinated with that of the rotating drum surface, as well as the other machine components through the main drive system whereby the support sheet is introduced into the transfer station in proper registration with the developed toner image supported on the xerographic plate. For further information concerning this type of sheet feeding mechanism, reference may be had to U.S. Pat. No. 3,731,915 to Guenther.

After transfer, but prior to the reintroduction of the imaged portion of the drum into the charging station, the plate surface is passed through a cleaning station 19 wherein the residual toner remaining on the plate surface is removed. The removed toner particles are collected within a container where they are stored subject to periodic removal from the machine.

Upon completion of the image transfer operation, the toner bearing support sheet is stripped from the drum surface and placed upon a moving vacuum transport 20 which serves to advance the support sheet into a thermal fusing station 21 wherein the toner image is permanently fixed to the sheet. The copy sheet with the fused image thereon is forwarded from the fuser into a collecting tray 22 where the sheet is held until such time as the operator has occasion to remove it from the machine.

Normally, when the copier is operated in a conventional mode, the original document to be reproduced is placed image side down upon a horizontal transparent viewing platen 23 and the stationary original then scanned by means of the moving optical system 24. The scanning system 24 fundamentally consists of a lens 25 positioned below the right hand margin of the platen as viewed in FIG. 1, and a pair of cooperating movable scanning mirrors 26 and 27. The lens is basically a half-lens objective having a reflective surface 28 at the stop position to simulate a full lens system. The two mirrors are slidably supported between a pair of parallel horizontally aligned guide rails (not shown). For a further description and greater details concerning this type of optical scanning system reference is had to U.S. Pat. No. 3,832,057 to Shogren.

In practice, mirror 26, herein referred to as the full rate scan mirror, is caused to move from a home position, directly below the left hand margin of the platen to an end of scan position below the opposite margin of the platen. The rate of travel of the scan mirror is synchronized to the peripheral speed of the rotating xerographic drum surface S. The second mirror 27 is simultaneously caused to move in the same direction as the scanning mirror at half the scanning rate. As the two mirrors sweep across the platen surface, an image of each incremental area thereon viewed by the scanning mirror is reflected towards the second mirror which, in turn, redirects the image back to the half lens system. The reflecting surface, positioned at the lens stop position, reverses the entering light rays and redirects the light rays back towards a stationary mirror 29 positioned directly above the drum surface at the exposure station 14. In this manner a flowing light image containing the original input scene information is focused upon the charged photoconductive plate.

A wind up spring (not shown) is provided to restore the moving mirrors to a start of scan condition.

The copying apparatus 10 shown in FIG. 1 is provided with a document feeder 30. The document feeder 30 is movable between a first stored position adjacent to the viewing platen 23 and a second operative position over the platen surface. Commensurate with the positioning of the feeder assembly over the platen, the moving optical system 24 is locked in a position to view documents as they are advanced by the document feeder over the platen and record a flowing light image of the input information upon the moving photoconductive plate surface S.

During one mode of operation, that is, when the moving optics are utilized to provide a flowing light image of the stationary original, the document feeding assembly is maintained in a stored position (as depicted by the phantom lines shown in FIG. 1) to expose the entire platen surface area and thus provide a maximum working area for the operator. To initiate a moving document mode of operation, the machine operator simply advances the document feeding assembly 30 from the stored position to a document feeding position with the feeding assembly extending over the left hand margin of the platen surface.

The document feeder 50 is arranged to move the document at a velocity which is synchronous with the velocity of the photosensitive surface S. It is not necessary, however, for the document velocity to be the same as that of the photosensitive surface, but merely that it be proportionally related and synchronized with it. For example, for a 1:1 magnification mode of operation the document would move at the peripheral velocity of the drum. For a reduced magnification mode of operation the document would move at a proportionally increased velocity as compared to the peripheral velocity of the drum.

This synchronization can be accomplished by using a common drive motor for both the drum and the document feeder as is the case, for example, in a Xerox 3100 LDC copier. A further description of such a drives approach may be had by reference to the Hoppner et al patent noted in the background.

In practice, at the start of the moving document handling conversion cycle, the machine operator grasps the lever arm 39 mounted on the document feeder and rotates the arm in a clockwise direction. Movement of the arm in a clockwise direction causes the movable document feeder assembly 50 to be advanced toward the fully extended or operative position. Rotation of the arm in the opposite direction produces the opposite result.

Manually moving the document feeder 30 to the extended position also physically closes the contacts of a large document mode switch (not shown) causing a signal to be sent to the main machine drive motor (not shown) actuating the motor. At the same time, a signal is also sent to the machine logic control system placing the machine in a single copy mode of operation. This latter step is required in order to move the optical system from its normal rest position, which is the start of scan position at the left hand end of the platen surface, to the end of scan position beneath the now fully extended feed roll assembly. However, during this initial conversion phase, no original is actually being processed and there is, therefore, no need to feed copy sheets through the copier. In point of fact, feeding a copy sheet during the conversion phase would have a deleterious effect on the various machine components as well as confusing the machine programming and registering system. To prevent this occurrence, means 50, as shown in FIG. 1, are provided for inhibiting the action of the paper feeder during the period when the machine is being converted to the moving document mode of operation. Means 50 also provide for locking the optics at the end of scan position during the moving original mode of operation. Means 50 comprise a lock-out mechanism which serves to both uncouple the drive shaft from the main drive system and hold the optics rigidly in a fixed position for viewing moving documents subsequently advanced through the document feeding assembly 30.

Further details of the inhibitor and lock-out means 50 may be obtained by reference to the above-noted Hoppner et al patent and application.

The machine which has been discussed thus far is similar in many respects to the aforenoted Xerox 3100 LDC copier. It is capable of operating in a number of modes including a scanning mode wherein a stationary original is scanned by the moving optical system 24 as well as a moving original mode wherein the original itself is moved in synchronism with the peripheral velocity of the drum and the optical system is held stationary. This latter approach is useful principally in a single copy mode in the apparatus described, however, it facilitates the copying of originals having a size larger than the platen.

In accordance with the present invention yet other or different modes of operation may be provided for a reproducing machine. One different mode of operation comprises a reduction mode wherein the image on the original is reduced in size by the optical system for projection onto the photosensitive surface whereby the image which is transferred to the sheet of final support material is similarly reduced in size. In accordance with the reproducing machine of this invention, the reduction mode is accomplished by a moving original exposure system.

For the reduction mode of operation it is necessary to translate the lens 25 to change the conjugate distance between the lens and the object and image planes. Further, it is necessary to advance the document past the fixed optics 24 at a velocity greater than the peripheral velocity of the drum S.

In accordance with a preferred embodiment of the present invention. the previously noted optical system of the Shogren patent is modified to provide for lens translation and the insertion of an add mirror 60 into the optical path to change the platen 23 to lens conjugate. The optical system which is utilized herein is similar in most respects to that described in application. Ser. No. 588,974 to Spinelli et al. The optical system of that application provides in addition to the optical system of the Shogren patent an add reflector 60 which is selectively positionable into the optical path to combine with the half rate mirror 27 to form a reflection cavity and change the object distance for magnification change. The lens 25 is movable relative to the optical path (as shown in phantom) to adjust the conjugate distance. Of course, by the nature of a half (Catadioptric) lens 25 with its associated reflector 28 the optical path incident to the lens and reflected back through the lens is at some angle relative to the lens axis. When a magnification change necessitates repositioning of the lens, the repositioning must take into account the divergence of the lens axis and optical path. In the optical system described in the aforenoted Spinelli et al application, the insertion of the add reflector 60 displaces the optical path 61 to 61' and, therefore, the lens 25 with its lens reflector 28 is shifted to satisfy conjugate distance requirements and to remain centered on the optical (principal ray) path 61'.

The actual means for moving the lens does not form part of the present invention and various devices for translating a lens for changing the projected image magnification of an optical system are known as described in the various patents noted in the background of this invention.

In order to obtain varying projected image magnifications by moving original exposure, it is necessary to advance the document past the optical viewing system at a velocity which varies depending upon the magnification which is selected. Various drive mechanisms are known which would enable the document feeder 35 to be driven selectively at one of a plurality of desired speeds corresponding to the given magnifications or minification selections. See, for example, that described in U.S. Pat. No. 3,200,275 to Hewes et al.

Figure 2:
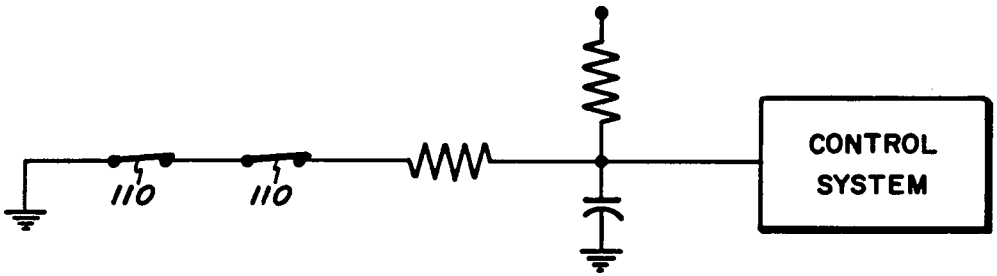
FIG. 2 PRIOR ART
FIG. 2 is an electrical schematic diagram of a prior art exposure initiating control system for a reproducing machine.

Referring now to FIG. 2, there is shown a prior art system for operating a copier in a moving original mode of exposure. In this system a pair of switches 110, as in FIG. 1, are utilized as start print switches and are operative upon being actuated by the lead edge of the sheet being advanced. In FIG. 2, two such switches are shown and in practice as in the Xerox 3100 LDC copier two such switches which are spaced apart along a line transverse to the direction of sheet feed are employed. Actuation of one or both of the switches 110 causes them to be opened and to signal the start of operation to the copying machine control system, which as in the 3100 LDC copier, programs the respective machine operations described above in an appropriately timed sequence so that there is proper registration between the copy sheet and the original document.

Optical exposure of the document therefor takes place in a timed relationship to the actuation of the switch 110 by the lead edge of the document. Normally, the switch 110 is positioned upstream of the viewing position 30 so that exposure takes place at some time interval following switch actuation. When copying at varying magnifications using moving original exposure the document lead edge from which exposure initiation is timed moves at different velocities depending on the magnification selected. Therefore, if the time interval from switch 110 actuation to exposure is set for 1:1 copying, and a reduction mode is selected, the document being advanced will reach the viewing position before the time interval has expired. Therefore, the time interval must be adjusted relative to the magnification which is selected.

Therefore, one of a plurality of selectable time delays is provided between the actuation of the start print switches 110 and the initiation of optical exposure. Each time delay is selected to compensate for the changes in document velocity associated with the magnification selected.

The moving original mode of exposure with the smallest time delay between switch 110 actuation and optical exposure comprises a base mode, and all other modes of moving original exposure at whatever magnification are considered in reference to the base mode. If it is assumed that the smallest time delay will be associated with the document being advanced at the highest velocity, then the base mode would correspond to the mode of reduction magnification.

Figure 3:
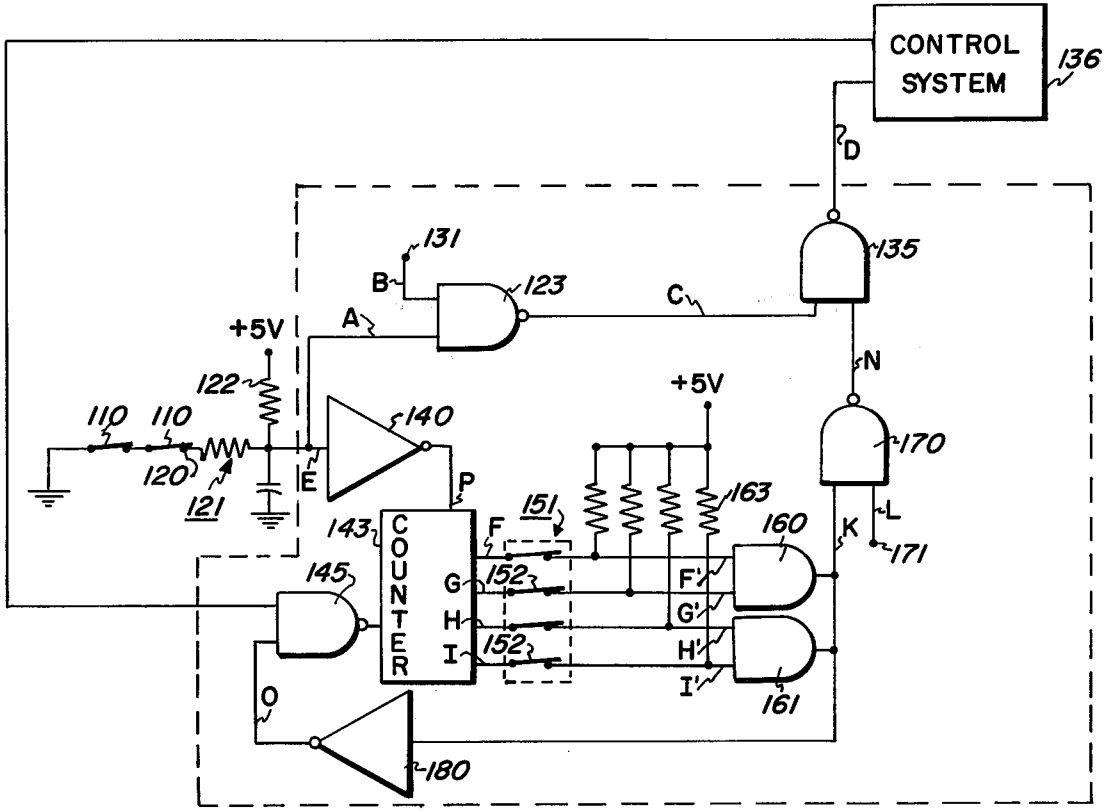
FIG. 3 is an electrical schematic of an exposure initiating control system for a reproducing apparatus in accordance with one embodiment of the present invention.

Referring to FIG. 3, upon the actuation (opening) of a print switch 110 a signal appears at terminal 120 which comprises the input of a noise suppression circuit 121 comprising the resistor and capacitor in the conventional arrangement shown. Pull up resistor 122 provides a high level signal A at one input of NAND gate 123. The other input of the NAND gate 123 is tied to a mode selector switch such as wafer switch 200 in FIG. 6 through a terminal 131. level signals If a base mode of magnification is selected, then a high level signal B is applied to the second input to NAND gate 123. Upon the concurrence of high level-signals A and B at each of the inputs to the NAND gate 123, a low output signal C is generated which is applied to one of the inputs of NAND gate 135. This results in a high signal D on the output of NAND gate 135 which acts to initiate a copying run by application to the machine control system 136 in the same manner as the direct application of the start print signal from the start print switch of a conventional apparatus as in FIG. 3.

If, a mode of exposure is selected wherein a greater time delay is required, then it is necessary to increase the time delay from switch 110 actuation to optical exposure as aforenoted. In this case, the mode selection switch will provide a low signal B at the input to NAND gate 123, thereby disabling this gate. A high level signal E is applied to the input to inverter 140 which provides a low signal P at its output.

The time delay is provided by means of a four bit binary counter 143. The low signal P from inverter 140 is applied to counter 143 to enable the counter. The counter counts clock pulses which are gated to it from the master clock (not shown) of the machine's control system through NAND gate 145. Four output signals F, G, H, and I, from the binary ring counter corresponding to desired binary numbers are routed through a first bank 151 of switches 152 to respective inputs of AND gate decoders 160 and 161. Pull up resistors 163 are provided in each input line to the decoding gates 160 and 161 to provide high signals F′, G′, H′, and I′, at a given input if the switch in the respective line is open.

By opening or closing the switches 152 in the switch banks 151 one can decode any desired count within the range of the counter to provide an output signal K from the decoding AND gates 160 and 161 indicating the end of time delay interval.

The use of an "in-line" switchbank 151 as shown, enables the time delay interval to be adjusted. For the counter 143, time intervals from 0 to 15 counts can be decoded which would correspond to a time interval of 0 to 0.25 seconds assuming a 60 hertz clock pulse is gated to the counter. In the embodiment shown in FIG. 3, switch bank 151 will decode a count of 15. The counts which will be decoded can be adjusted, as desired, by selectively opening or closing the respective switches 152 in each bank 150 or 151.

The output signal K from the AND gate decoders 160 and 161 corresponding to the end of the time delay is applied to an input terminal of NAND gate 170. The second input of NAND gate 170 is connected to the mode selecting switch through terminal 171. When a mode other than the base mode is selected the second input signal L to NAND gate 170 is high. When the appropriate count is decoded by the gates 160 and 161 the output signal K is high so that the output signal N of NAND gate 170 is low. The low signal N from gate 170 is applied to NAND gate 135 resulting in a high signal D at the output of gate 135 which is applied to the machine control system 136 to initiate the copying operation.

The high signal K at the output of decoding AND gates 160 and 161 is applied to the input of inverter 180 providing a low output signal O which is applied to one of the inputs of NAND gate 145 to disable it and stop further clock pulses from being gated into the counter. When the switches 110 are returned to their normally closed position, counter 143 is reset so that it is ready for the next copying operation.

The above-described digital time delay circuit comprising counter 143, in-line switch bank 151, and decoders 160 and 161 is similar in many respects to that described in U.S. application Ser. No. 503,584 to Taylor, now abandoned and refiled as U.S. application Ser. No. 654,449, filed Feb. 2, 1976, for a buckle height control system in a sheet feeder.

The selectable time delay apparatus of this invention for use in controlling exposure in a copying machine having one or more modes of moving original exposure uniquely allows a single sensor to be utilized for modes of exposure involving differing document velocities. The difference in document velocity from one mode of exposure to another is compensated for by means of a selectable time delay. In accordance with this invention each of the selectable time delays is itself adjustable within a range of time delays intervals. This is an important aspect of the present invention in that it allows the time delay interval to be adjusted to compensate for tolerances and other manufacturing differences between machines. Perhaps of even greater importance, however, this adjustable feature would allow the particular magnification and document velocity selected for a given machine to be varied within a certain range.

Therefore, in accordance with the present invention, a reproducing apparatus can be provided including one or more modes of reduction and each mode of reduction may be selected within a range of reduction ratios. For example, the machine could be set up to the reduction ratio of 0.6:1 or a reduction ratio of 0.7:1 as a customer might desire. The only difference in the apparatus itself would comprise a small change in the position of the lens 25 and add mirror 60 as well as a change in the document velocity. An appropriate adjustment to the time interval from switch actuation to exposure could be made using the selectively actuable switches 152 in the switch bank 151.

Therefore, it is apparent that it is quite important in accordance with the present invention that the time delay intervals themselves be adjustable within a given range to allow for compensation for manufacturing differences between machines as well as to allow for greater flexibility in the selection of a desired mode of reduction based upon customer need.

The apparatus described by reference to FIGS. 1 and 3 is shown to include but two modes of moving original exposure, one at a 1:1 ratio, and one at a reduction ratio. It should be apparent to those skilled in the art that such an apparatus could readily be modified to provide additional modes of reduction, etc.

Figure 4:
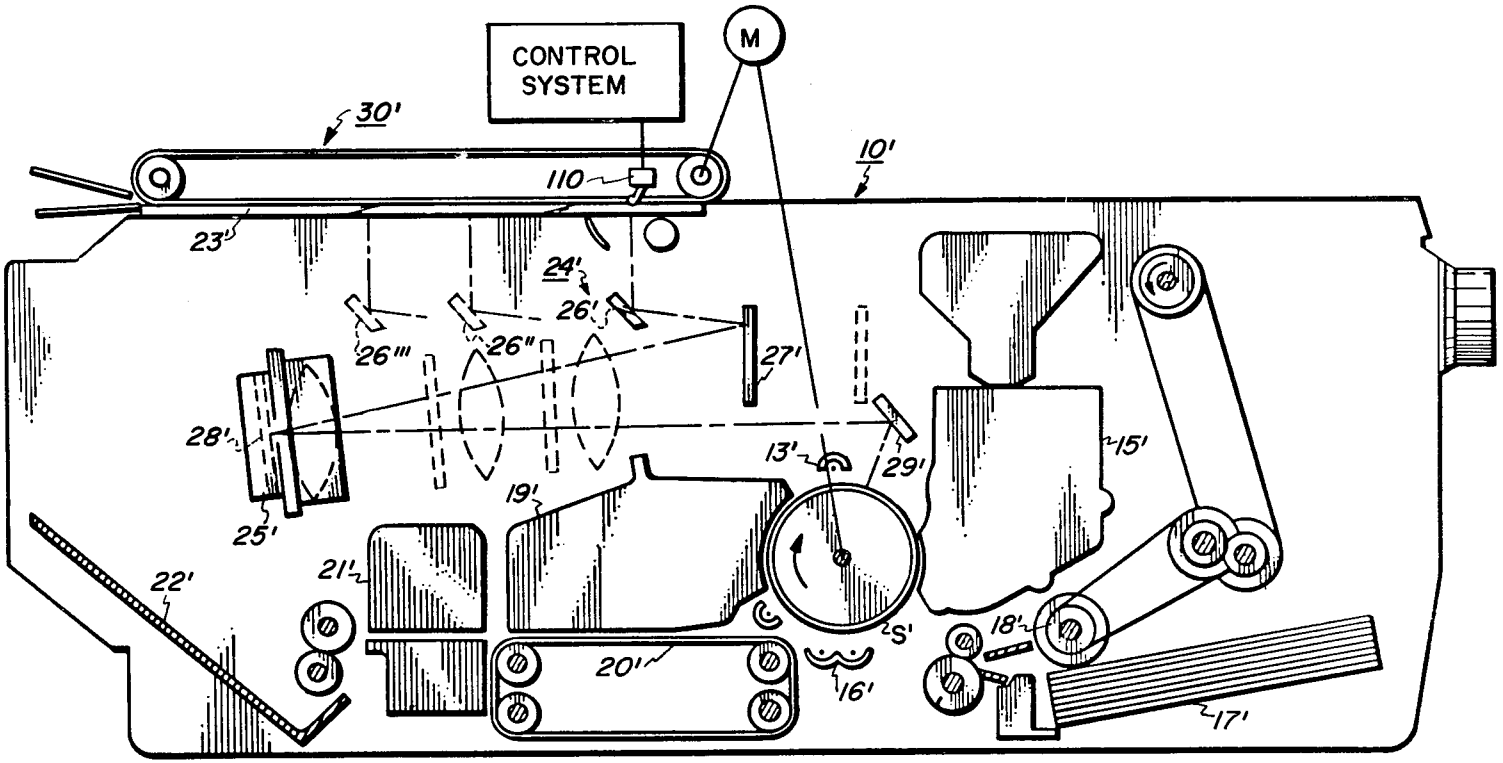
FIG. 4 is a schematic side view of a reproducing apparatus in accordance with an alternative embodiment of the present invention.

Alternatively, other desired magnifications could be provided by using an apparatus of the type as shown by reference to FIG. 4. The apparatus shown in FIG. 4 is similar in most respects to that described in the aforenoted application of Bierworth et al. It is also similar in many respects to that described by reference to FIG. 1 as evidenced by the use of primed numbers for similar sub-systems. Those elements shown primed operate in the same fashion as the unprimed elements in FIG. 1 described above, except as otherwise described hereafter. For the sake of brevity their operation will not be described again here except where necessary to illustrate the differences between the two embodiments.

The apparatus of FIG. 4 is adapted to copy original documents selectively at one of a plurality of desired copy image magnifications. It is possible with this apparatus to provide as many different copy image magnifications as are desired and potentially to infinitely vary the magnifications without the necessity of an add mirror as in the previously discussed embodiment.

This is accomplished by fixing the full rate scanning reflector 26' at one of a plurality of different viewing positions 26', 26'', or 26''', etc., along its path of travel (shown in phantom) depending on the copy image magnification which is desired. In the embodiment shown, a document feeder 30' of a belt-type is substituted for the roll type feeder 30 described by reference to the previous embodiment. The document feeder 30' advances the document over the platen 23' past the optical system 24 which has been fixed at a desired viewing position 26'. In FIG. 4, three different viewing or imaging positions 26', 26'', and 26''' are shown for the mirror 26'. However, any desired number of positions and selectable magnifications could be employed. The position 26' shown in solid lines comprises the end of scan position and in this position the relationship between the mirrors 26' and 27' is essentially the same as that in a Xerox 3100 LDC copier and can provide about a 1:1 original image to projected image ratio. If it is desired, however, to provide copy images having different magnification ratios than 1:1, then preferably the mirror 26' is held at positions 26'' or 26''', etc., which are prior to its end of scan position and along its path of travel, and the mirror 27' is preferably held at its end of scan position.

In accordance with this embodiment the viewing positions 26', etc., of the optical system 24 are shifted depending on the projected image magnification selected. This may be accomplished by any desired means such as that described in the aforenoted Bierworth et al application. This necessitates a further adjustment of the time interval from switch 110 actuation to exposure so that exposure will occur at the appropriate viewing position.

In the apparatus of FIG. 4, for purposes of example, it will be assumed that position 26' corresponds to a 1:1 ratio of original image to projected image magnification, and that positions 26'' and 26''' correspond to first and second reduction ratios, respectively. The amount of reduction being greater for position 26''' than for position 26''. Correspondingly, therefore, the velocity at which the document feeder will advance the document will be greatest when viewing position 26' is selected.

Therefore, one of a plurality of selectable time delays is provided between the actuation of the start print switches 110 and the initiation of optical exposure. Each time delay is selected to compensate for the changes in viewing position 26'', etc., and document velocity associated with the magnification selected.

As with the previously described embodiment, the moving original mode of exposure with the smallest time delay between switch 110 actuation and optical exposure comprises a base mode, and all other modes of moving original exposure at whatever magnification are considered in reference to this base mode. If it is assumed that the smallest time delay will be associated with the document being advanced at the highest velocity irrespective of viewing position, then the base mode would correspond to the mode of greatest reduction which would correspond in turn to viewing position 26'''. In practice, however, depending upon the effect of viewing position on the time delay, the base mode may not be the one of greatest reduction. For purposes of simplicity, however, it will be assumed to be the case for this description.

Figure 5:
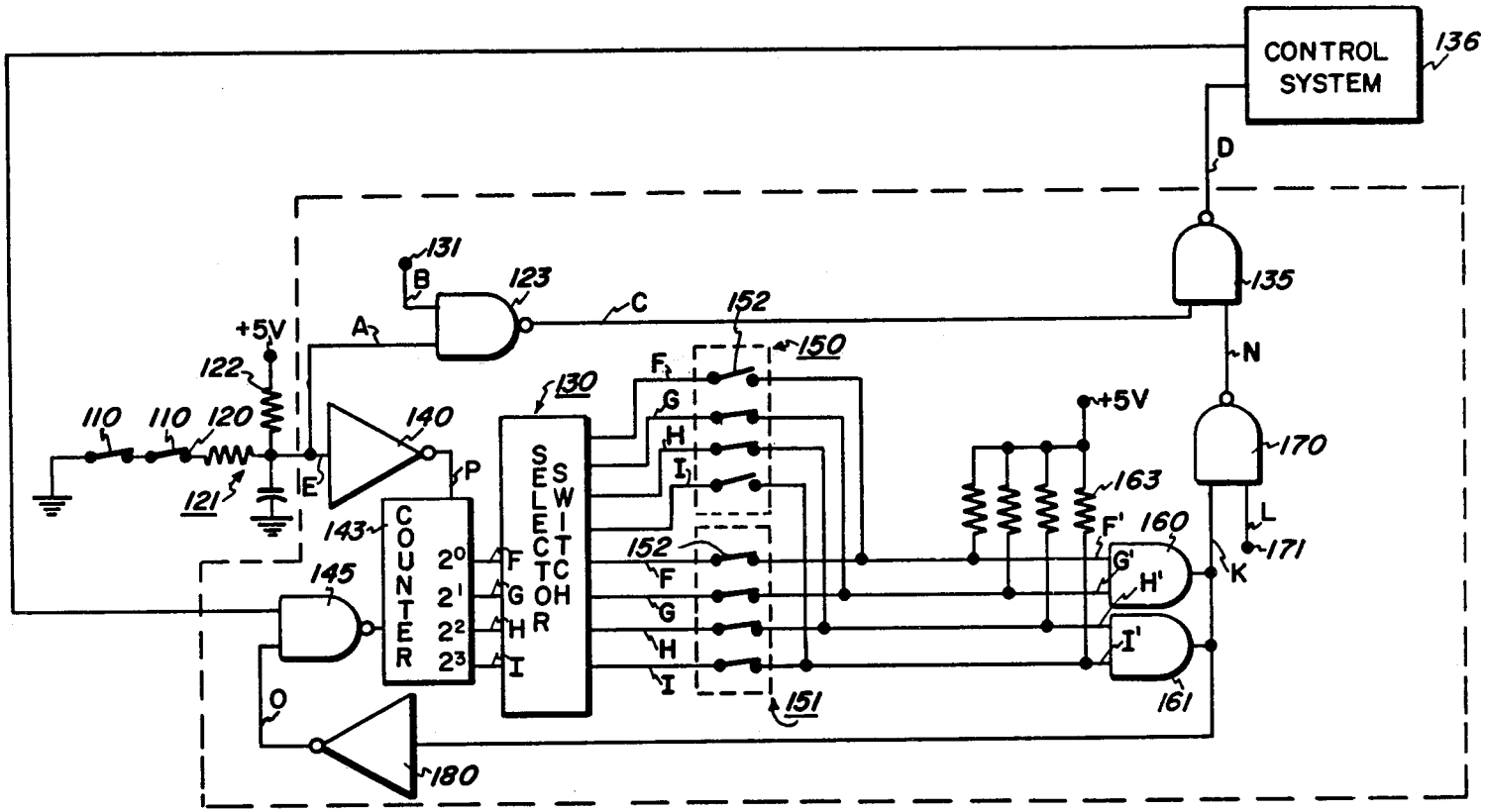
FIG. 5 is an electrical schematic of an exposure initiating control system for a reproducing apparatus in accordance with the alternative embodiment of this invention.

The time delay may be accomplished by a means as shown in FIG. 5, similar in many respects to that described by reference to FIG. 3. Like elements in FIGS. 3 and 5, have been numbered the same, and function in accordance with the previously described embodiment. The essential differences between the circuits of FIGS. 3 and 5 are that in the circuit of this embodiment an additional switch bank 150 of "in-line" switches 152 is provided and a selector switch 130 is interposed between the counter and the switch banks 150 and 151. The purpose of this selector switch is to route the appropriate signals F, G, H, and I, from the counter to the switch bank corresponding to the mode of moving original exposure which has been selected. The selector switch 130 will be described in greater detail hereafter by reference to FIG. 6.

By opening or closing the switches 152 in the respective switch banks 150 and 151, one can decode any desired count within the range of the counter to provide an output signal K from the decoding AND gates indicating the end of the time delay interval.

In this embodiment switch bank 150 will decode a count of 6 whereas switch bank 151 will decode a count of 15 as in the previous embodiment. The counts which will be decoded can be adjusted as desired by selectively opening or closing the respective switches 152 in each bank 150 or 151.

It is apparent that the operation of the circuit shown in FIG. 5 is identical to that shown in FIG. 3 with the exception that multiple banks of switches 152 are utilized along with a switch for routing signals from the counter to one of the banks of switches 152 in accordance with the mode of exposure which is selected.

Figure 6:
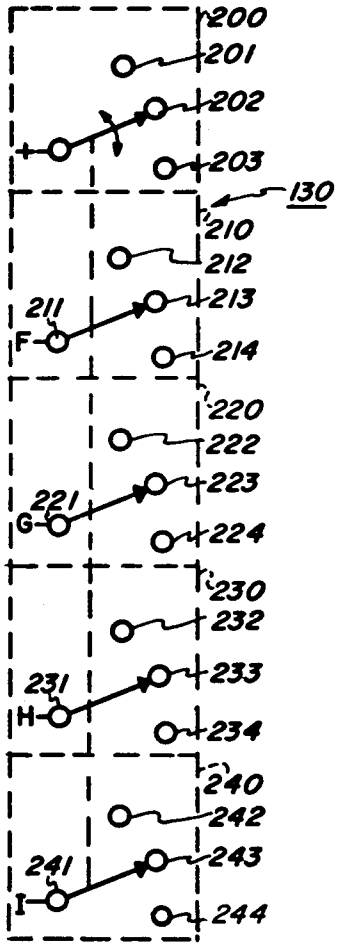
FIG. 6 is a more detailed schematic representation of the selector mechanism in FIG. 5.

FIG. 6 shows further details of the selector switch 130 set forth in FIG. 5. The selector switch comprises a ganged rotary wafer type switch. The first wafer switch 200 comprises a mode selection switch wherein the base mode or two alternative reduction modes of moving original exposure may be selected. The output terminal 201 corresponds to the base mode of moving original exposure and is connected to terminal 131 of NAND gate 123. Output terminals 202 and 203 corresponding to other modes of moving original exposure are connected to terminal 171 of NAND gate 170. When terminals 201, 202, 203 are not selected, they are connected to ground by conventional circuit means, not shown, to provide a low signal. The signals at terminals 201, 202, and 203 are also applied to the machine control logic to appropriately condition the machine, by any desired means, in the desired mode of moving original exposure.

Four additional wafer switches 210, 222, 230, and 240 are provided. The signals F, G, H, and I, are applied to terminals 211, 221, 231, and 241, respectively, of the wafer switches 210, 220, 230, and 240. Terminals 212, 222, 232, and 242 corresponding to a base mode selection are not operatively connected in the circuit. Terminals 213, 223, 233, and 243 correspond to selection of a reduction magnification mode of operation different from the base mode, and are connected to switch bank 150 to apply signals F, G, H, and I, to the respective switches 152 therein. Terminals 214, 224, 234, and 244 correspond in this embodiment to the selection of a 1:1 mode of moving original exposure and are connected to switch bank 151 to apply signals F, G, H, and I, to the respective switches therein.

The use of a ganged switch arrangement 130 provides mode selection and corresponding routing of the outlet signals from the counter to the appropriate switch bank 150 or 151.

The counter 143 described provides output signals corresponding to binary numbers up to 15, If desired, however. a higher capacity counter could be employed so that higher counts can be decoded to provide longer time intervals. In the apparatuses described in FIGS. 3 and 5, a base mode of operation is shown without an adjustable time delay interval. If desired, all modes of operation could employ adjustable time delay intervals in accordance with this invention.

While the invention has been described by reference to embodiments employing two scanning mirrors and a half lens in the optical system any desired optical system adapted to provide moving original exposure could be employed. It is not essential in accordance with the present invention to have a stationary original mode of exposure. If there is a stationary original mode of exposure the scanning need not be carried out by moving mirrors. e.g., a moving lens or other alternatives could be employed. If reflectors are employed in the optical system of this invention, they need not be mirrors since other optical elements of a similar nature could be used.

The patents, patent applications, and texts specifically set forth in this application are intended to be incorporated by reference into the description.

The term electrostatographic as employed in the present application refers to the formation and utilization of electrostatic charge patterns for the purpose of recording and reproducing patterns in viewable form.

It is apparent that there have been provided in accordance with this invention apparatuses which fully satisfy the objects, means and advantages set forth hereinbefore. While the invention has been described in conjunction with specific embodiments therefor. it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for producing copies of a document selectively at one of a plurality of copy image magnifications comprising:

an imaging surface arranged for movement at a given velocity;

means for viewing a moving document and for projecting an image thereof onto said imaging surface selectively at one of a plurality of copy image magnifications;

feeding means for advancing said document along a path along a path past said viewing means selectively at one of a plurality of velocities corresponding to said copy image magnifications and synchronised with the movement of said imaging surface; the improvement wherein said apparatus further includes:

means arranged at a given position along said path for sensing an edge of said document at a desired position along said path, as it is advanced by said feeding means;

circuit means responsive to said sensing means sensing said edge of said document at said given position for initiating exposure of said document by said viewing means selectively after expiration of one of a plurality of time intervals following the sensing of said edge at said position, said time intervals corresponding to said copy image magnifications and said velocities of document advancement.

2. An apparatus as in claim 1, wherein said feeding means advances said document continuously and said sensing means senses a lead edge of said document as it is continuously advanced.

3. An apparatus as in claim 1, further including:

means for selecting a desired copy image magnification; and means responsive to said selection means for conditioning said exposure initiating means to expose said document after experimentation of a time interval corresponding to the selected copy image magnification and velocity of document advancement.

4. An apparatus as in claim 1, further including means for adjusting said time intervals within a time interval range.

5. An apparatus as in claim 1, wherein said exposure initiating means includes digital circuit means for providing said plurality of time intervals.

6. In a reproducing apparatus for producing copies of a document selectively at one of a plurality of copy image magnifications comprising: an imaging surface arranged for movement at a given velocity;

a plurality of document viewing positions corresponding to different desired copy image magnifications;

means for viewing a moving document selectively at any desired one of said viewing positions and for projecting an image thereof onto said surface selectively at one of said plurality of magnifications corresponding to said one position;

feeding means for advancing said document along a path along a path past said viewing positions and viewing means selectively at one of a plurality of velocities corresponding to said copy image magnifications and synchronized with the movement of said imaging surface; the improvement wherein said apparatus further comprises:

means arranged at a given position along said path for sensing an edge of said document at a desired position along said path as it is advanced by said feeding means;

circuit means responsive to said sensing means sensing said edge of said document at said given position for initiating exposure of said document by said viewing means selectively after expiration of one of a plurality of time intervals following the sensing of said edge at said position, said time intervals corresponding to said copy image magnifications. said velocities of document advancement, and said viewing positions.

7. An apparatus as in claim 6, wherein said feeding means advances said document continuously and said sensing means senses a lead edge of said document as it is continuously advanced.

8. An apparatus as in claim 6, further including:

means for selecting a desired copy image magnification; and means responsive to said selection means for conditioning said exposure initiating means to expose said document after expiration of a desired time interval corresponding ponding to the selected copy image magnification, document advancement velocity and viewing position.

9. An apparatus as in claim 6, further including means for adjusting said time intervals within a time internal range.

10. An apparatus as in claim 6, wherein said exposure initiating means includes digital circuit means for providing said plurality of time intervals.

* * * * *